United States Patent [19]

Sorenson

[11] 4,367,386

[45] Jan. 4, 1983

[54] SNAP-ON ACTUATOR FOR MINIATURE TOGGLE SWITCH

[75] Inventor: Richard W. Sorenson, Avon, Conn.

[73] Assignee: Carlingswitch, Inc., West Hartford, Conn.

[21] Appl. No.: 224,649

[22] Filed: Jan. 12, 1981

[51] Int. Cl.[3] ..... H01H 3/20

[52] U.S. Cl. ..... 200/333; 200/339

[58] Field of Search ..... 200/333, 339, 330, 302

[56] References Cited

U.S. PATENT DOCUMENTS

| | | | |
|---|---|---|---|
| 2,440,943 | 5/1948 | Gonsett et al. | 200/333 |
| 2,807,692 | 9/1957 | Leslie | 200/333 |
| 3,188,458 | 6/1965 | Lovasco | 200/333 |
| 3,471,158 | 10/1969 | Solins | 200/333 |
| 3,852,557 | 12/1974 | Brown | 200/339 |
| 3,959,618 | 5/1976 | Carroll | 200/330 |

*Primary Examiner*—Willis Little

*Attorney, Agent, or Firm*—McCormick, Paulding & Huber

[57] ABSTRACT

A snap-on actuator converts a toggle switch to a rocker switch without the necessity for pivotally supporting the rocker independently of the toggle. Depending skirts on the rocker actuator engage flats on the bushing, through which the toggle extends, and convexly contoured surfaces engage the upper end of the bushing to support the actuator during its motion. A paddle shaped actuator is also disclosed, and has such skirts and convexly contoured support surfaces.

8 Claims, 4 Drawing Figures

SNAP-ON ACTUATOR FOR MINIATURE TOGGLE SWITCH

This invention relates generally to electrical switches, and deals more particulary with a toggle switch of very small dimensions having a short toggle projecting outwardly through an opening defined in the cover of the switch, and more particularly in the bushing portion thereof.

Miniature toggle switches have typically been constructed with bases made entirely of an insulating material, and the bushing portion of such a switch normally has been of either metal or an insulating material. Such switches have generally required metal or plastic mounting brackets for pivotally supporting a rocker or paddle type actuator at the pivot points on both sides of the actuator when it is desired to provide such an actuator for the switch in lieu of the toggle normally provided with such a switch.

The present invention provides a convenient snap-on actuator for a standard configuration of a miniature toggle switch and it is a feature of the present invention that no additional mounting means is necessary for pivotally supporting and maintaining orientation of a rocker or paddle type actuator on such a switch.

Figure 1:
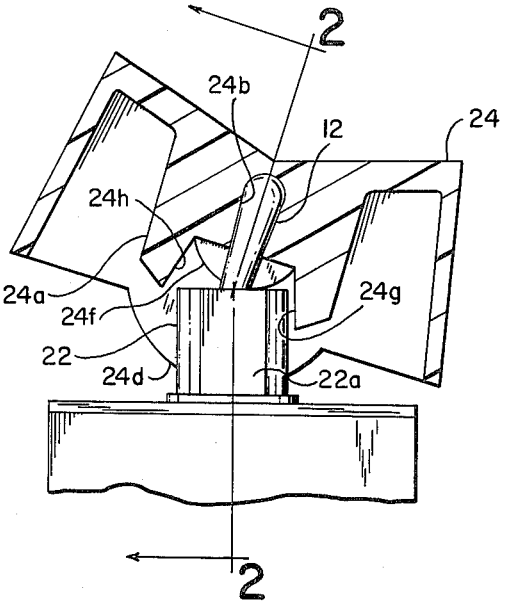
FIG. 1 shows the top portion of a typical miniature toggle switch with a bushing embodying two flat sides parallel longitudinally to the switch base, with a rocker type actuator fitted thereto, the rocker being shown in vertical section to better reveal the construction thereof.
Figure 2:
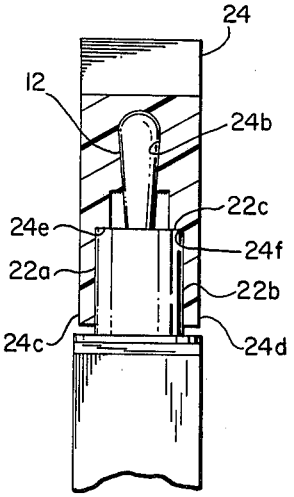
FIG. 2 is a vertical sectional view through the rocker of FIG. 1, being taken generally on the line 2—2 of FIG. 1.
Figure 3:
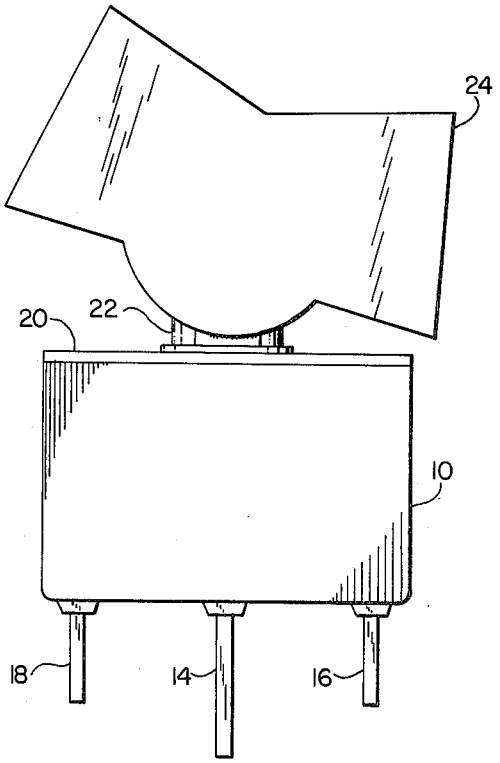
FIG. 3 is a side elevational view of a complete switch and snap-on rocker style actuator of the type shown in FIGS. 1 and 2.

Turning now to the drawings in greater detail, FIG. 3 shows a conventional miniature toggle switch case 10 of the type having an upwardly open lower portion defining a cavity for receiving a movable contact (not shown) which movable contact is adapted to be shifted between two or more positions as a result of manually moving an upstanding toggle actuator 12 best shown in FIGS. 1 and 2 so as to selectively bridge the internal fixed contacts (not shown) generally provided in such a switch. These contacts are electrically connected to the terminals indicated generally at 14, 16 and 18 in FIG. 3.

The switch case 10 has a cover portion 20 which may be attached to the upwardly open case by any suitable means, and which cover portion includes an upstanding bushing 22 of conventional configuration in that the bushing is hollow and pivotally supports the toggle actuator 12 as a result of internal spring pressure or by other means which cooperate with the toggle actuator 12 to define at least two positions for the toggle 12. In certain embodiments of such a switch the toggle actuator may be capable of three positions, and FIG. 1 shows the toggle actuator 12 in one limit position. It will be apparent to those skilled in the art that a similarly arranged limit position is defined by the mirror image position for the actuator 12, but such alternative limit position has not been shown in the drawing.

Still with reference to the upstanding bushing 22, it is noted that this part may be either of plastic or metal, but preferably it includes diametrically opposed flats **22*a* and 22*b*. The bushing 22 has an upper end 22*c* of generally annular contour which annular surface 22*c* surrounds the central opening through which the toggle actuator 12** projects.

Figure 4:
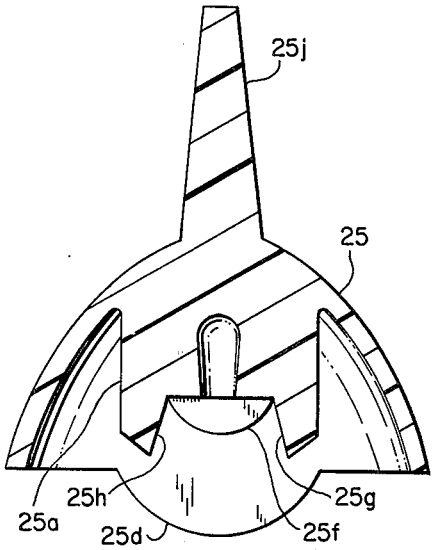
FIG. 4 is a sectional view taken through an alternative construction for a paddle type snap-on actuator, suitable for use on the switch depicted in FIGS. 1, 2 and 3.

As so constructed and arranged the above described structure comprises a complete switch in that toggle actuator 12 can be manipulated from the position shown to other alternative switch positions in order to select the desired connection between each of the several terminals 14, 16 and 18. In accordance with the present invention an additional snap-on actuator 24 is provided on the toggle actuator 12 in order to facilitate manipulation of the switch from and to its various positions. FIG. 4 shows an alternative snap-on actuator 25.

Both style actuators 24 and 25 include a depending portion which defines a downwardly open recess for securely receiving the toggle actuator 12. For example, the rocker style actuator 24 includes a depending portion **24*a*, best shown in FIG. 1, and paddle style actuator 25 of FIG. 4 includes a depending portion 25*a*, which portion is generally similar to the portion 24*a* of FIG. 1**.

The rocker style actuator 24 defines a downwardly open recess **24*b* which is shaped to snugly receive the bat shaped toggle actuator 12 in a slight interference fit such that the operator 24 is securely held to the actuator 12 once it is assembled therewith. It should be noted that the actuator or toggle 12 comprises a body of revolution with the result that the rocker 24 might be expected to be free to rotate on the actuator 12 were it not for the unique cooperation between portions of the actuator 24 and the flats 22*a* and 22*b* of the bushing 22. More particularly, depending skirts 24*c* and 24*d* are defined on the underside of actuator 24 in downwardly and laterally spaced relation to the toggle actuator recess 24*b*. These skirts 24*c* and 24*d* slidingly engage the flats 22*a* and 22*b*** as a result of movement of the snap-on rocker/paddle actuator and toggle actuator in the manner set forth above.

The depending portion **24*a* of actuator 24 also defines a downwardly open recess for loosely receiving the bushing 22 and it will be apparent that the inner wall thereof defines toggle actuator recess 24*b*. This inner wall of the bushing recess also defines convexly contoured guide surfaces 24*b* and 24*f* which guide surface engages the upper end 22*c* of the bushing 22** during movement of the toggle and its associated snap-on actuator.

Finally, and still with reference to the rocker style actuator 24 depicted in FIG. 1, it is noted that the above described opening for loosely receiving the bushing 22 further includes end walls **24*g* and 24*h* oriented substantially perpendicular to the depending skirts 24*d* and 24*c*, one of which end walls is adapted to abut said bushing when the actuator 24 is moved beyond the normal limit position for the toggle actuator 12 as depicted in FIG. 1 for end wall 24*g*. End wall 24*h* serves the same purpose for the other limit position for actuator 24** (not shown).

The paddle style actuator 25 of FIG. 4 includes an upstanding paddle defining portion **25*j* symmetrically arranged on the otherwise generally symmetrical convex upper surface of actuator 25. The depending portion 25*a* of the paddle style actuator 25 includes the same surfaces as described above with reference to the actuator 24 of FIG. 1 and the same reference numeral subscripts have been used in connection with actuator 25 in order to delineate these various surfaces. Thus, the only difference between the actuator shown in FIG. 4 and that of FIG. 1 resides in the configuration for the upper surface of the actuator in that actuator 24 has angularly related flat finger engaging surfaces, such as found in so-called rocker style switches, whereas the actuator 25 of FIG. 4 defines a paddle 25***j* in place of the rocker style configuration depicted in FIG. 1 for actuator 24.

I claim:

1. In combination with an electrical switch of the type having an upstanding bushing with diametrically opposed flats and a movable toggle having a portion projecting upwardly from a top opening defined by the upper end of said bushing, the improvements comprising a one-piece plastic actuator for said switch toggle, said actuator having a downwardly open toggle recess for snugly receiving the projecting portion of said toggle, said actuator defined toggle recess having its open end more particularly defined by an inner wall of a larger downwardly open recess for movably receiving said bushing and said inner wall defining guide surfaces engaging the upper end of said bushing during movement of said toggle and said actuator defined larger recess having depending skirts spaced laterally from said toggle recess and slidably engaging said flats on said bushing during movement of said toggle and said actuator.

2. The combination of claim 1 wherein said guide surfaces for engaging the upper end of said bushing during movement of said toggle are convexly contoured to engage the generally flat upper end of said bushing.

3. The combination of claim 2 wherein said actuator defined larger bushing recess includes end walls oriented substantially perpendicular to said depending skirts, each end wall adapted to abut said bushing when said actuator and toggle are moved beyond a normal limit position for said toggle.

4. The combination of claim 3 wherein said actuator has a concave upper surface defined by symmetrically arranged angularly related flat finger engaging surfaces such as are found in a so-called rocker type of switch.

5. The combination of claim 3 wherein said actuator has an upper surface defined by an upwardly projecting paddle, and said upper surface having convex complementary portions arranged symmetrically to either side of said paddle.

6. In combination with an electrical switch of the type having an upstanding bushing with diametrically opposed flats and a movable toggle having a portion projecting upwardly from a top opening defined by the flat upper end of said bushing, the improvement comprising a one-piece plastic actuator having a downwardly open toggle recess for snugly receiving the projecting end portion of said toggle, said actuator defined toggle recess having its open end more particularly defined by an inner wall of a larger downwardly open recess which permits pivotal movement of said actuator relative to said bushing, and said inner wall defining diametrically opposed convexly contoured guide surfaces engaging the upper end of said bushing during pivotal movement of said actuator and toggle.

7. The combination of claim 6 wherein said actuator defined larger recess has depending skirts spaced laterally from said toggle recess and slidably engaging said flats on said bushing during pivotal movement of said actuator and toggle.

8. The combination of claim 7 wherein said actuator defined larger recess includes longitudinally spaced end walls oriented substantially perpendicular to said depending skirts, each end wall adapted to abut said bushing to prevent movement of said actuator and toggle beyond a normal limit position for the toggle.

* * * * *